US005153090A

United States Patent [19]

Swidler

[11] Patent Number: 5,153,090

[45] Date of Patent: Oct. 6, 1992

[54] CHARGE DIRECTORS FOR USE IN ELECTROPHOTOGRAPHIC COMPOSITIONS AND PROCESSES

[75] Inventor: Ronald Swidler, Palo Alto, Calif.

[73] Assignee: CommTech International Management Corporation, Menlo Park, Calif.

[21] Appl. No.: 546,044

[22] Filed: Jun. 28, 1990

[51] Int. Cl.[5] ..... G03G 9/00

[52] U.S. Cl. ..... 430/115; 430/112; 430/114

[58] Field of Search ..... 430/114, 115, 112

[56] References Cited

U.S. PATENT DOCUMENTS

| | | |
|---|---|---|
| 3,012,969 | 12/1961 | van der Minne et al. . |
| 3,150,976 | 9/1964 | Johnson . |
| 3,406,062 | 10/1968 | Michalchik . |
| 3,409,358 | 11/1968 | Fauser . |
| 3,411,936 | 11/1968 | Roteman et al. . |
| 3,417,019 | 12/1968 | Beyer . |
| 3,577,259 | 5/1971 | Sato et al. . |
| 3,615,392 | 10/1971 | Honjo . |
| 3,669,886 | 6/1972 | Kosel . |
| 3,671,290 | 6/1972 | Matsumoto et al. . |
| 3,679,453 | 7/1972 | Katagiri et al. . |
| 3,692,520 | 9/1972 | Mammino et al. . |
| 3,692,523 | 9/1972 | Tamai et al. . |
| 3,738,832 | 6/1973 | Matsumoto et al. . |
| 3,753,760 | 8/1973 | Kosel . |
| 3,779,924 | 12/1973 | Chechak . |
| 3,788,995 | 1/1974 | Stahly et al. . |
| 3,900,412 | 8/1975 | Kosel . |
| 3,971,659 | 7/1976 | Sato et al. . |
| 3,990,980 | 11/1976 | Kosel . |
| 3,991,226 | 11/1976 | Kosel . |
| 4,032,463 | 6/1977 | Kawanishi et al. . |
| 4,081,391 | 3/1978 | Tsubuko et al. . |
| 4,155,862 | 5/1979 | Mohn et al. . |
| 4,156,034 | 5/1979 | Mukoh et al. . |
| 4,157,974 | 6/1979 | Brechlin et al. . |
| 4,170,563 | 10/1979 | Merrill et al. . |
| 4,202,785 | 5/1980 | Merrill et al. . |
| 4,206,064 | 6/1980 | Kiuchi et al. . |
| 4,229,513 | 10/1980 | Merrill et al. . |
| 4,557,991 | 12/1985 | Takagiwa et al. . |
| 4,564,574 | 1/1986 | Uytterhoeven et al. . |
| 4,639,404 | 1/1987 | Uytterhoeven et al. . |
| 4,659,640 | 4/1987 | Santilli . |
| 4,663,265 | 5/1987 | Uytterhoeven et al. . |
| 4,681,831 | 7/1987 | Larson et al. . |
| 4,701,387 | 10/1987 | Alexandrovich et al. . |
| 4,719,165 | 1/1988 | Kitatani et al. . |
| 4,762,764 | 8/1988 | Ng et al. . |
| 4,789,616 | 12/1988 | Croucher et al. . |
| 4,794,651 | 12/1988 | Landa et al. . |
| 4,812,377 | 3/1989 | Wilson et al. . |
| 4,837,394 | 6/1989 | Alexandrovich et al. . |
| 4,845,003 | 7/1989 | Kiriu et al. . |
| 4,869,991 | 9/1989 | deGraft-Johnson et al. . |
| 4,897,332 | 1/1990 | Gibson et al. . |
| 4,918,047 | 4/1990 | Ikeda et al. . |
| 4,925,766 | 5/1990 | Elmasry et al. . |
| 4,946,753 | 8/1990 | Elmasry et al. . |
| 4,988,602 | 1/1991 | Jongewaard et al. ..... 430/115 |
| 5,028,508 | 7/1991 | Lane et al. ..... 430/115 |

FOREIGN PATENT DOCUMENTS

| | | |
|---|---|---|
| 848902 | 8/1970 | Canada . |
| 54-101328 | 8/1979 | Japan . |
| 55-6220 | 2/1980 | Japan . |
| 58-107550 | 6/1983 | Japan . |
| 59-29861 | 7/1984 | Japan . |
| 61-69073 | 4/1986 | Japan . |
| 62-86369 | 4/1987 | Japan . |
| 62-163061 | 7/1987 | Japan . |
| 63-52376 | 10/1988 | Japan . |
| 1211771 | 8/1989 | Japan ..... 430/115 |
| 1278858 | 6/1972 | United Kingdom . |
| 1442835 | 7/1976 | United Kingdom . |

*Primary Examiner*—Marion E. McCamish
*Assistant Examiner*—S. C. Crossman
*Attorney, Agent, or Firm*—Morrison & Foerster

[57] ABSTRACT

Novel compounds useful as charge directors in color electrophotographic processes are described. Developer compositions containing the novel charge directors are provided as well. The developer compositions display high particle-mediated conductivity and charge and thus give rise to a final print of exceptionally high quality. Methods of manufacturing the toner and developer compositions are also disclosed, as are processes for using the various compounds and compositions in consecutive multicolor image development.

11 Claims, No Drawings

CHARGE DIRECTORS FOR USE IN ELECTROPHOTOGRAPHIC COMPOSITIONS AND PROCESSES

TECHNICAL FIELD

The present invention relates generally to the field of color electrophotography, and more particularly relates to a novel class of charge directors for use in color electrophotographic processes. The invention additionally relates to developer compositions containing the novel charge directors and to consecutive multicolor image development processes utilizing the novel compositions.

1. Background

Preparation of printed images by electrophotographic, or "xerographic", processes involves coating a selected substrate, or xerographic plate (typically comprised of metal, glass or plastic), with a photoconductive insulating material such as selenium, and then providing an electrostatic charge on the photoconductive surface, e.g., by ionization from a corona discharge. A light image is then focused onto the charged surface, which discharges or lowers the potential of the irradiated areas, while leaving the remainder of the surface charged. The electrostatic image so formed is then made visible by application of a suitable developing composition, which may be in either dry or liquid form.

Conventional liquid developer compositions comprise a dispersion of pigment particles in an insulating carrier liquid. Application of such a composition to the substrate carrying the electrostatic image results in migration of charged pigment particles to the substrate surface and deposition thereon in conformance with the electrostatic image. The developed image is then transferred to another substrate such as paper. (In some cases, it is desirable to eliminate the intermediate step of image transfer, i.e., so that the developed image is directly produced upon the final surface; see, e.g., U.S. Pat. No. 3,052,539 to Greig.)

Liquid developers for use in multicolor image development are relatively recent, and are comprised of colorant embedded in a thermoplastic resin core. These "toner" particles are then dispersed in an insulating carrier medium as above. Like compositions used in black-and-white electrophotography, these developer compositions additionally contain "charge directors", or "charge control agents", to control the charge acquired by the toner particles in the insulating liquid.

When a color image is to be produced electrophotographically, the above-described charging, exposure, and development steps are carried out separately in succession for each of the constituent colors of the image using a correspondingly colored toner. In some color printing processes, each of the color images is transferred from the electrophotographic member to a print substrate after development and prior to formation of the next color image. This process, however, requires extremely accurate registration of the successive color images on the substrate to which they are transferred in order to obtain a high-quality composite image.

Another color printing process, and the process currently in use commercially, is a four-color liquid electrophotographic process known as "consecutive color toning" or "consecutive multicolor image development". This process involves: (1) charging a photoconductive ("pc") surface; (2) impressing a first latent image on the surface by exposure through a colored transparency; (3) developing the image by contacting the pc with a liquid developer composition of a first color, typically yellow; and (4) discharging the pc surface. The steps are then repeated in sequence, typically using magenta, cyan, and black developer compositions, i.e., the cyclic process is repeated until the colored image is complete.

A significant problem which has been encountered in consecutive color toning is "image" or "character" staining, that is to say, where a second process color overtones the first image in regions where portions of the first image should have been discharged but were not. See, for additional explanation of the problem, R.M. Schaffert, *Electrophotography* (London: Focal Press, 1975), at pp. 184–186.

Many schemes have been advanced to overcome this difficulty. In U.S. Pat. No. 4,701,387 to Alexandrovich et al., for example, the problem of residual toner is discussed. The inventors propose a solution wherein the developed surface is rinsed with a polar liquid after each development step. It is suggested that application of a polar rinse liquid neutralizes and solvates residual counterions deriving from charge control agents and stabilizers present in the liquid developer.

While the Alexandrovich et al. method may be effective in reducing the staining problem, such a multiple washing procedure is time-consuming and unwieldy (it is recommended in the '387 patent that "after each development step and before the next developer is applied, the developed image is rinsed . . . After rinsing, the rinse liquid is removed from the photoconductive element by drying, wiping or other method . . . "; see col. 2, lines 62–67).

U.S. Pat. No. 2,986,521 to Wielicki proposes the use of photoconductive toner particles to permit dissipation of charge applied to a toner layer during exposure of a second or subsequent color image to avoid charge retention in those areas. Such developers, however, may also be sufficiently conductive in the dark to dissipate the charge where it is intended to be retained during a subsequent imaging process, thereby preventing the subsequent image from being developed in those areas. U.S. Pat. No. 3,687,661 to Sato et al. seeks to overcome the problem resulting from retained charge by applying a reverse-polarity charge which neutralizes any charge retained in previously developed regions of the electrophotographic member. Such additional steps, however, not only prolong the processing time required to produce a composite color image, but also add to the complexity of the electrophotographic apparatus.

Other problems frequently encountered in electrophotographic color processes include: background staining, i.e., the appearance of toner in uncharged, non-image areas (a problem which is ubiquitous in zinc oxide and other positive toner systems); poor image resolution (i.e., poor edge acuity); poor image density resulting from insufficient deposition of toner particles in intended image regions; and colorant exposure, in which colorant contained within the resinous toner particles is exposed to the developer solution (as well as to the substrate) and thus affects the chemistry of the particular developer composition.

The invention herein now provides compositions and processes which address and overcome each of the aforementioned problems. First with respect to image staining in multicolor image development, the present toner and developer compositions substantially eliminate the cause of the problem and avoid the time-consuming, multi-step procedures of the prior art. The presently disclosed compositions and processes also enable preparation of a final electrophotographic print of unexpectedly high quality, with respect to both image density and edge acuity. The problems of colorant exposure and background staining are also virtually eliminated as will be described in detail below.

Citation of Prior Art

R.M. Schaffert, *Electrophotography* (London: Focal Press, 1975), provides a comprehensive overview of electrophotographic processes and techniques. Representative references which relate to the field of color electrophotography, specifically, include U.S. Pat. Nos. 3,060,021 to Greig, 3,253,913 to Smith et al., 3,285,837 to Neber, 3,337,340 to Matkan, 3,553,093 to Putnam et al., 3,672,887 to Matsumoto et al., 3,687,661 to Sato et al., and 3,849,165 to Stahly et al. References which describe electrophotographic toners and developers include U.S. Pat. Nos. 4,659,640 to Santilli (which describes a developer composition containing dispersed wax), 2,986,521 to Wielicki, 3,345,293 to Bartoszewicz et al., 3,406,062 to Michalchik, 3,779,924 to Chechak, and 3,788,995 to Stahly et al.

References which relate to charge directors, include U.S. Pat. Nos. 3,012,969 to van der Minne et al. (polyvalent metal organic salts in combination with an oxygen-containing organic compound), 3,411,936 to Rotsman et al. (metallic soaps), 3,417,019 to Beyer (metallic soaps and organic surface active agents), 3,788,995 to Stahly et al. (various polymeric agents), 4,170,563 to Merrill et al. (phosphonates), 4,229,513 (quaternary ammonium polymers), 4,762,764 to Ng (polybutene succinimide, lecithin, basic barium petroleum sulfonates, and mixtures thereof), and *Research Disclosure*, May 1973, at page 66.

U.S. Pat. No. 4,701,387 to Alexandrovich et al., discussed in the preceding section, and U.S. Pat. No. 3,337,340 to Matkan, are relevant insofar as each of these references relates to the problem of image staining in consecutive color toning.

Co-pending, commonly assigned patent applications Ser. Nos. 07/356,264, filed May 23, 1989, 07/355,484, filed May 23, 1989, 07/398,460, filed Aug. 25, 1989, and 07/464,896, filed Jan. 16, 1990, all relate to one or more aspects of the present invention and are incorporated by reference herein.

SUMMARY OF THE INVENTION

Accordingly, it is a primary object of the present invention to provide novel compounds useful as charge directors in electrophotographic process.

It is another object of the invention to provide electrophotographic developer compositions which contain the novel charge directors as will be described herein and which overcome the above-mentioned deficiencies of the prior art.

It is still another object of the invention to provide compositions and processes for obtaining a high resolution, high density electrophotographic color print with a minimum of image and background staining.

It is yet another object of the invention to provide processes for manufacturing such compositions.

It is a further object of the invention to provide an improved consecutive color toning process using the novel developer compositions.

Additional objects, advantages and novel features of the invention will be set forth in part in the description which follows, and in part will become apparent to those skilled in the art upon examination of the following, or may be learned by practice of the invention.

The above objects are accomplished in accordance with the present invention by, first of all, providing novel compounds useful as charge directors in the electrophotographic processes described herein, wherein the compounds comprise a metal salt of the formula $(X^-)_aM^{+n}(AA^-)_b$ in which: M is a metal atom; $AA^-$ represents the anion of an ortho-hydroxy aromatic acid; $X^-$ represents the anion of an $\alpha,\beta$-diketone; n is 2, 3 or 4; and a and b are integers the sum of which is equal to n, with the proviso that neither a nor b is 0. Such compounds, in contrast to virtually all of the charge directors available to date, are useful in both liquid electrophotographic processes as well as in dry powder development, are easily synthesizable in pure form, are not water-sensitive, and are quite stable under a variety of conditions. In a preferred embodiment, as will be discussed in detail below, the charge directors of the invention comprise a trivalent metal salt of an ortho-hydroxy aromatic acid and an $\alpha,\beta$-diketone.

In another aspect of the invention, a developer composition is provided which comprises, dispersed in an electrically insulating carrier liquid: toner particles of a colored resinous phase; an antistain agent; and a charge director comprising a metal salt as described above.

Other aspects of the invention include processes for making and using the above-described developer compositions.

In still other aspects of the invention, consecutive color toning processes are provided which utilize the novel charge directors and developer compositions. The processes involve repeating the following sequence of steps with the different color developers: charging a pc surface; impressing a first latent image on the surface; developing the image by application of the novel liquid developer composition; and then discharging the pc surface. Unlike the prior art consecutive color toning processes, however, the method of the invention involves no intermediate processing steps, i.e., rinsing, drying, or the like, while nevertheless providing a high quality, high resolution final image with a minimum of image and background staining.

DETAILED DESCRIPTION OF THE INVENTION

Definitions

"Toner" as used herein is intended to denote the resinous, colored toner particles themselves.

By "developer composition" as used herein is meant a dispersion of toner, antistain agent, and charge director in the selected insulating carrier liquid. The developer composition may contain a number of additional components as will be described below.

"Particle-mediated" conductivity and charge is intended to mean that virtually all of the conductivity and charge in a developer composition derives from the charged toner particles and not from free, unassociated salts which may be present in solution (i.e., from unassociated charge director or other ionizable species). The compositions of the invention display very high particle-mediated conductivity and charge and very low continuous phase conductivity.

"Consecutive color toning" as used herein is intended to mean an electrophotographic development process involving repetition of charging and development steps with more than one color (as outlined in the Background Section above) so as to provide a multicolor final image. The process is also sometimes referred to herein as "consecutive multicolor image development".

By "incompatible" as used herein to describe the separate, solid phase that is preferably incorporated into the toner particle during manufacture is meant: (1) substantially immiscible with the resinous phase of the toner, substantial immiscibility in turn implying a tendency not to blend or mix (two "substantially immiscible" materials will tend to disperse freely in a given solvent, rather than tending to aggregate); and (2) insoluble in the hydrocarbon medium of the liquid developer composition, i.e., having a solubility of less than about 50 ppm, more preferably less than about 10 ppm, therein.

A "color blind" developer is intended to denote a developer composition whose chemistry and electrophotographic properties are independent of the particular colorant used. In order to ensure color blindness, exposure of the colorant contained within the resinous phase of the toner particles must be substantially prevented.

"Background staining" is a problem which can arise in any electrophotographic process. As used herein the term has its art-recognized meaning and refers to the problem wherein toner appears in unintended, uncharged, non-image areas.

"Image staining" is a problem which is specific to consecutive color toning, and similarly has its art-recognized meaning as used herein. The problem involves overtoning by a second or subsequent process color of an earlier color image in regions where portions of the earlier image should have been discharged but were not. "Image staining" is also sometimes referred to herein and in the art as "character staining".

By "antistain" agents as used herein applicant intends to include anionic, cationic, amphoteric and nonionic surfactants which are substantially immiscible with the resinous phase of the toner particles. As will be described in detail herein, such compounds address and significantly reduce the problem of image staining in consecutive color toning.

The Novel Charge Directors

The novel compounds of the invention, useful as charge directors in electrophotographic processes, are of the formula $(X^-)_aM^{+n}(AA^-)_b$ in which M, $AA^-$, $X^-$, n, a, and b are as defined above.

In these compounds, the various substituents are selected such that the equilibrium of complexation between toner and charge director favors formation of the charged toner particle/charge director complex. The substituent $AA^-$, as noted above, represents the anion of an ortho-hydroxy aromatic acid. Suitable ortho-hydroxy aromatic acids include those described in parent application Ser. No. 07/398,460 as well as other ortho-hydroxy aromatic acids which may be monomeric, oligomeric or polymeric. Examples of specific ortho-hydroxy aromatic acids useful for incorporation into the novel charge directors include salicylic acid and derivatives thereof. By "derivatives" of salicylic acid applicants intend to include salicylic acid substituted with one to four, typically one to two, substituents independently selected from the group consisting of lower alkyl (1-6C), lower alkoxy (1-6C), halogen, amino, hydroxy, nitro and sulfonate. The particular identity of the ortho-hydroxy aromatic acid used is not, however, critical; it suffices that a hydroxy and a carboxy moiety be proximal on the particle surface so as to act together in chelating a single metal ion. (See, for example, A.E. Martell et al., *Critical Stability Constants*, vol. 3 (New York: Plenum Press). One example of a particularly preferred counterion is diisopropyl salicylate (DIPS).

The metal atom "M" may be divalent, trivalent or tetravalent, with trivalent metals most preferred (in which case "n" is 3). As explained in co-pending application Ser. No. 398,460, previously incorporated by reference herein, trivalent metal atoms will give rise to the highest degree of charge stabilization when used in conjunction with ortho-hydroxy aromatic acids (see Schemes 1 and 2 therein). A particularly preferred metal is aluminum.

The anion $X^-$, as noted above, represents the anion of an $\alpha,\beta$-diketone, one which preferably has the formula:

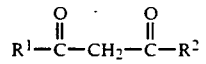

wherein $R^1$ and $R^2$ are independently selected from the group consisting of hydrogen, alkyl, alkenyl, alkynyl, cycloalkyl, haloalkyl, aryl, alkaryl, and haloaryl. If alkyl, alkenyl, alkynyl, cycloalkyl, or haloalkyl, the substituent preferably contains from about 1 to about 12 carbon atoms, more preferably from about 1 to about 6 carbon atoms (wherein the latter type of moiety is sometimes referred to herein as "lower" alkyl, akenyl, alkynyl, etc.). If aryl, alkaryl, or haloaryl, the substituent preferably contains one to about three rings, more preferably, one to two rings, and most preferably is monocyclic. An example of a particularly preferred $\alpha,\beta$-diketone is acetyl acetone, i.e., wherein $R^1$ and $R^2$ are both methyl.

These charge directors may be synthesized quite easily in quantitative yield, as follows. The metal salt $MX_n$ ($MX_3$ when the metal M is a trivalent atom such as aluminum) is admixed with the selected aromatic acid in a suitable organic, preferably nonpolar, solvent, and heated. The product is recovered by removal of the solvent and may be purified using conventional means.

The novel charge directors are useful with any number of toner and developer systems, including those set forth in copending, commonly assigned U.S. patent application Ser. Nos. 07/356,264, 07/355,484, 07/398,460 and 07/464,896, incorporated by reference above. It should also be emphasized that although the present disclosure focuses on the use of the novel charge directors in liquid developer systems, the compounds also have utility in dry powder systems.

While not wishing to be bound by theory, it is postulated that because the $\alpha,\beta$-diketone has a relatively high pKa (on the order of about 10), and the corresponding anion is thus a relatively strong base, a higher charge concentration is provided on the toner particle than can be achieved using other types of charge directors. Additionally, the metal salts disclosed herein as novel charge directors display a chemical insensitivity to water which is believed to prevent gelation of liquid developer systems formulated with the compounds. Finally, the novel compounds, in combination with other features of the present invention, provide a number of unique and important advantages in color electrophotographic image development which are described at length hereinabove.

Developer Compositions

A primary focus of the present invention is on novel developer compositions which provide a number of important and distinct advantages. That is, in the liquid developers of the invention, conductivity and charge are both substantially particle-mediated, in turn (1) enabling one to carry out consecutive color toning without the intermediate processing steps required by prior art systems, e.g., rinsing, drying, etc.; (2) giving rise to a final image in which virtually no image or background staining is apparent; and (3) significantly enhancing the density of the final image.

The components of the developer composition, i.e., toner as will be described below, antistain agent, and charge directors, all dispersed in an electrically insulating carrier liquid, enable preparation of a system in which virtually all conductivity and charge derives from the toner particles, the toner is highly charge—stabilized, i.e., will retain charge over a prolonged period of time, and the toner particles are themselves highly charged. These features yield a final image of exceptionally high quality, i.e., with respect to image density, edge acuity, and the like, and also enable use of the toner in a consecutive color process without need for intermediate processing steps which have heretofore been necessary to remove residual toner in unwanted, "non-image", areas.

The toner particles for use herein comprise a resinous phase containing colorant. The resins and colorants which are used in formulating the toner may be selected from a wide variety of materials well known in the art of electrophotography. In general, a broader range of both resins and colorants may be used in the present process than in prior art processes. Conventionally, softer resins have been avoided because of problems with aggregation and flocculation. The present invention, however, by virtue of the incompatible phase which is preferably incorporated into the toner, as will be explained in detail below, substantially eliminates the problem of aggregation regardless of the resin used. Similarly, because the incompatible phase eliminates the problem of colorant exposure, a wide variety of colorants may now be used as well; the electrical and other chemical and physical properties of the liquid developer composition are no longer affected by the choice of colorant.

Resins useful in liquid electrophotographic developers, generally, are characterized as being insoluble or only slightly soluble in the insulating carrier liquid. They are also typically, although not necessarily, "oleophobic" as defined above. Preferred resins should not swell in the carrier liquid, nor, clearly, should they destabilize the developer composition in any way. Examples of suitable resins for use herein include: alkyd and modified alkyd resins cured with polyisocyanate, melamine formaldehyde or benzoguanamine; epoxy ester resins; polyester resins; copolymers of styrene, acrylic and methacrylic esters with hydroxyethyl methacrylate, hydroxyethyl acrylate, hydroxypropyl methacrylate, or the like; other polyacrylates; phenolic resins such as phenol formaldehyde resins and derivatives thereof; ethylene-acrylic acid copolymers; ethylene-vinyl alcohol copolymers and ionomers thereof; styrene-allyl alcohol copolymers; cellulose acetate-butyrate copolymers; and polyethylene and polyethylene copolymers.

The colorants which may be used include virtually any pigments, dyes or stains which may be incorporated in the toner resin and which are effective to make visible the electrostatic latent image. Examples of suitable colorants include: Phthalocyanine blue (C.I. 74160), Diane blue (C.I. 21180), Milori blue (an inorganic pigment equivalent to ultramarine) as cyan colorants; Brilliant carmine 6B (C.I. 15850), Quinacridone magenta (C.I. Pigment Red 122) and Thioindigo magenta (C.I. 73310) as magenta colorants; benzidine yellow (C.I. 21090 and C.I. 21100) and Hansa Yellow (C.I. 11680) as yellow colorants; organic dyes; and black materials such as carbon black, charcoal and other forms of finely divided carbon, iron oxide, zinc oxide, titanium dioxide, and the like.

The optimal weight ratio of colorant to resin in the toner particles is on the order of about 1:1 to 25:1 , more preferably about 5:1 to 15:1. The total dispersed material in the carrier liquid typically represents 0.5 to 5 wt. % of the composition.

It is preferred that the toner comprise a separate, solid incompatible phase as described in co-pending application Ser. No. 355,484. As explained in that application, incorporation of an incompatible phase into a toner composition during manufacture eliminates many of the problems inherent in the compositions of the prior art, and provides a number of advantages. For example, the incompatible phase enables preparation of much finer particles, which ultimately result in a better developer dispersion and a much higher quality final image; the incompatible phase also ensures "color blindness" of the toner in that colorant exposure on the surface of the toner particle is substantially prevented. As explained above, color blindness of a toner is desirable to ensure that the differently colored developers will display chemistry and electrophotographic properties which are independent of the colorant.

Generally, the incompatible phase will be "oleophilic". The term "oleophilic" as used herein has its art-accepted meaning, i.e., it is intended to denote a class of substances which are compatible with or soluble in nonpolar organic liquids. (Oleophilicity can also be defined in terms of a partition coefficient. Preferably, the oleophilic materials used herein have an n-octane:-water partition coefficient of at least 2, more preferably at least 3.) This is in contrast to the preferred resins for use in making the toner, which, relative to the materials selected for the incompatible phase and the carrier liquid, are "oleophobic", i.e., tending to be more compatible with or soluble in aqueous materials.

The incompatible phase may comprise any material which can be incorporated into the toner particles using the above-described process, and which will result in a separate, solid phase, i.e., a phase that is resin-nonmiscible and thus distinct from the remaining, resinous phase of the toner particle. It is preferred that the incompatible phase, like the resinous phase, be of a material that does not swell in the carrier liquid. Particularly preferred materials for use as the incompatible phase are waxes such as carnauba wax, beeswax, candelilla wax, amide waxes, urethane-modified waxes (e.g., Petrolite WB-type), montan wax, Carbowax (Union Carbide), paraffin waxes, long-chain petroleum waxes, and other waxes as described in U.S. Pat. Nos. 3,060,021 and 4,081,391, both of which are incorporated herein by reference.

The developer, in addition to toner and charge director, contains an antistain agent (sometimes referred to herein as an "antistatic agent") to assist in reducing image staining upon use in consecutive color toning. As explained in parent application Ser. No. 07/356,264, image staining in consecutive color toning is believed to result from a residual surface charge (presumably resident on the dielectric toner pile) which remains after each individual exposure step. The antistain agent thus addresses the problem by neutralizing residual surface charge, i.e., by "bleeding" excess charge.

Suitable antistain agents include anionic, cationic, amphoteric or nonionic surfactants.

Anionic surfactants commonly contain carboxylate, sulfonate or sulfate ions. The most common cations in these materials are sodium, potassium, ammonium, and triethanolamine, with an average fatty acid chain length of 12 to 18. Examples of anionic surfactants are long-chain alkyl sulfonates such as sodium lauryl sulfate and alkyl aryl sulfonates such as sodium dodecylbenzene sulfonate.

Cationic surfactants are typically amine salts, quaternary ammonium salts, or phosphonium salts, the compounds containing a hydrophobic moiety such as a hydroxyl, long-chain alkyl, or aralkyl substituent.

Amphoteric agents include, for example, compounds which contain carboxylate or phosphate groups as the anion—e.g., polypeptides, proteins, and the alkyl betaines—and amino or quaternary ammonium groups as the cation, compounds which typically exist in a zwitterionic state.

Non-ionic surfactants include long-chain fatty acids and their water-insoluble derivatives, e.g., fatty alcohols such as lauryl, cetyl and stearyl alcohols, glyceryl esters such as the naturally occurring mono-, di- and triglycerides, fatty acid esters of fatty alcohols and other alcohols such as propylene glycol, polyethylene glycol, sorbitan, sucrose and cholesterol. These compounds may be used as is or modified so as to contain polyoxyethylene groups.

In the preferred embodiment, the antistain agent is a non-ionic surfactant. Examples of particularly preferred non-ionic surfactants for use herein are: (a) ethoxylated derivatives of fatty acids, alcohols and amides; (b) alkyl phosphates and phosphonates and metal salts thereof; (c) homopolymers of ethylene oxide; and (d) copolymers of ethylene and propylene oxide.

The developer of the invention contains the above-identified components—toner, charge director and antistain agent—dispersed in an electrically insulating carrier liquid as well-known in the art. The liquid is typically oleophilic, stable under a variety of conditions, and electrically insulating. That is, the liquid has a low dielectric constant and a high electrical resistivity so as not to interfere with development of the electrostatic charge pattern. Preferably, the carrier liquid has a dielectric constant of less than about 3.5, more preferably less than about 3, and a volume resistivity greater than about $10^9$ ohm-cm, more preferably greater than about $10^{10}$ ohm-cm. Examples of suitable carrier liquids include: halogenated hydrocarbon solvents such as carbon tetrachloride, trichloroethylene, and the fluorinated alkanes, e.g., trichloromonofluoromethane and trichlorotrifluoroethane (sold under the trade name "Freon" by the DuPont Company); acyclic or cyclic hydrocarbons such as cyclohexane, n-pentane, isooctane, hexane, heptane, decane, dodecane, tetradecane, and the like; aromatic hydrocarbons such as benzene, toluene, xylene, and the like; silicone oils; molten paraffin; and the paraffinic hydrocarbon solvents sold under the names Isopar G, Isopar H, Isopar K and Isopar L (trademarks of Exxon Corporation). The foregoing list is intended as merely illustrative of the carrier liquids which may be used in conjunction with the present invention, and is not in any way intended to be limiting.

Manufacture

Toner is prepared substantially as described in co-pending applications Ser. Nos. 356,264, 355,484, 398,460, and 464,896, i.e., using the following basic procedure.

Resin, colorant and an antistain agent are admixed at a temperature in the range of about 100° C. to 200° C. A two-roll mill, an extruder, an intensive mixer or the like, is used to ensure complete mixing. The admixture is then comminuted dry, i.e., without addition of liquid, to give intermediate particles typically averaging 30 microns in diameter or less. This dry cominution step is carried out in a jet mill, a hammer mill, or the like. The intermediate particles so obtained are then subjected to liquid attrition in a selected attrition liquid to give the final toner particles. The liquid used for attrition is typically selected from the same class of liquids useful as the carrier liquid for the developer composition, as will be described below.

It is also preferred that the "incompatible phase" be incorporated into the toner at the initial stage of manufacture, i.e., admixed with the colorant, resin, etc., in step (a). Toner particles obtained using the aforementioned manufacturing process in conjunction with the incompatible phase are very fine, averaging less than 2 microns in diameter, typically 1.5 to 2 microns in diameter, after only 0.5 to 4 hours of liquid attrition. Longer attrition times can give even finer particles, less than 1 micron in diameter. (The inventor herein has established, as described in the Example of co-pending application Ser. No. 355,484, that omission of the incompatible phase gives much larger, aggregated particles even after attrition periods of as long as 20 to 40 hours.) In addition, as noted in the co-pending applications incorporated by reference herein, the incompatible phase gives rise to "cohesive" rather than "adhesive" failure during comminution and attrition. In this way, exposure of the colorant on the surface of the toner particle is substantially prevented and the resulting composition is "color-blind" as defined above.

The charge director may also be incorporated initially, at the stage of toner manufacture, i.e., with the components as set forth in step (a) of the manufacturing process as described above, or it may be incorporated later, i.e., dispersed into the selected carrier liquid during preparation of the liquid developer composition.

A liquid developer composition is prepared from the toner by dispersing the above-mentioned toner, antistain agent, and charge director in a carrier liquid. As is well known in the art, and as explained above such carrier liquids may be selected from a wide variety of materials.

If the charge director is not incorporated into the toner during toner manufacture as outlined above, it is incorporated into the developer composition at this stage by dispersion into the selected insulating carrier liquid along with the toner. Similarly, the antistain agent may be dispersed into the carrier liquid rather than incorporated into the composition at the stage of toner manufacture. The developer composition may include additional materials as desired and as known in the art, e.g., dispersants, stabilizers, or the like.

Consecutive Multicolor Image Development

Briefly, a consecutive multicolor image development process (or a "consecutive color toning" process) according to the invention is carried out as follows.

The surface of a photoconductive insulating layer on a relatively conductive substrate is charged, and an initial electrostatic charge pattern (or "latent image") is formed on that surface by exposure through a colored transparency. This latent image is then developed with a liquid developer composition of a first color, i.e., comprising toner formulated with a first colorant, typically yellow. The photoconductive layer is then discharged, either optically or non-optically, i.e., via a corona. These steps are then repeated in sequence with developer compositions of different colors, typically (in order) magenta, cyan and black, at which point the developed image may, if desired, be transferred to another substrate, e.g., paper. Using the toner and developer compositions of the invention, it is possible to carry out the aforementioned sequence of steps without any intermediate processing steps, i.e., rinsing, drying or the like. These steps have typically been necessary in the prior art, as exemplified by the Alexandrovich et al. patent, cited supra, to address the problem of image staining. Because of the various features of the current invention which assist in overcoming the problem of image staining, however, it is no longer necessary to carry out the time-consuming and unwieldy processes taught by the prior art.

EXAMPLE 1

Preparation of Charge Director

This example illustrate the preparation of a charge director of the invention, having the formula Al(AcAc)$(DIPS)_2$ wherein "AcAc" represents acetyl acetonate, or

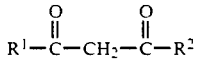

and "DIPS" represents diisopropyl salicylate, or

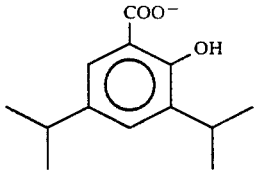

Aluminum acetyl acetonate (Aldrich Chemical Co., 6.4 g; 0.2 mL) and 8.88 g of diisopropyl salicylic acid (Aldrich Chemical Co. were dissolved in 100 g of toluene. The resultant solution was heated at 95°-100° C. for 2 hours. The solvent was removed at 95° C. (steam-bath) in vacuo leaving 11.3 g of a viscous glass. The latter was dissolved in 25 mL of hot acetone. Upon removal of the acetone in vacuo, a brittle foam resulted which was dried at 70° C. for 24 hours. For the product $C_{31}H_{41}O_8Al$, [Al(AcAc)$(DIPS)_2$], the theoretical percentage of Al is 4.75, while 4.73 was found. The product was readily soluble in Isopar and conferred a positive charge to toners at the rate of $10^{-7}$-$10^{-5}$ mole/g toner. (Similarly, the aluminum derivatives of other diketones, such as dibenzoyl methane, benzoyl acetonate, etc., as well as other aromatic acids, may be employed in this synthesis.)

EXAMPLE 2

Formulation of Toner and Developer 120 g of AC 295 (Allied-Signal Inc.) was placed onto a two-roll mill at 95° C. To the molten polymer was added 32.3 g of Heliogen Blue L, 2.9 g of Heliogen Green L and 0.8 g of Sicofast Yellow—D1155. Mastication of this mix was continued for 30 minutes effecting dispersion of the pigments. An additional 120 g of AC 295 was incorporated into the mix along with 13 g of carnauba wax. After thorough mixing, the charge was removed from the mill, cooled and cryogenically comminuted in a hammer mill to an approximately 30 $\mu$ powder. Thirty grams (30 g) of the above powder and 130 g of Isopar H (Exxon) was charged into a Union process 1-S liquid attritor. After 2 hours of attrition at 25° C. the toner exhibited a surface area of 5 $m^2/g$. The toner was discharged from the attritor to give a 10% solids concentrate. Forty grams (40 g) of the above concentrate was diluted to 400 g with Isopar G (Exxon) to give a 1% working toner bath. To this bath was added 2 g of a $5\times10^{-6}$ molar solution of Al(AcAc)$(DIPS)_2$ to give a stable positive charge toner. This toner was found to be suitable for producing dense, high-quality images on negative-charging photoconductors, including zinc oxide, OPC and the like. Similarly, magenta, yellow and black toners were prepared. A wide variety of polymeric binders and waxes were employed in these various compositions and indeed resulted in highly efficient positive working toners.

It is to be understood that while the invention has been described in conjunction with the preferred specific embodiments thereof, that the foregoing description including the examples are intended to illustrate and not limit the scope of the invention. Other aspects, advantages and modifications within the scope of the invention will be apparent to those skilled in the art to which the invention pertains.

I claim:

1. An electrophotographic liquid developer composition comprising, dispersed in an electrically insulating carrier liquid:

(a.) toner comprising particles of a colored resinous phase;

(b.) an antistain agent; and (c.) a charge director comprising a metal salt of the formula $(X^-)_aM^{+n}(AA^-)_b$ in which:

M is a metal atom;

$AA^-$ represents the anion of an ortho-hydroxy aromatic acid;

$X^-$ represents the anion of an $\alpha,\beta$-diketone;

n is 2, 3 or 4; and a and b are integers the sum of which is equal to n, with the proviso that neither a nor b is 0.

2. The developer composition of claim 1, wherein the charge director is of the formula $(X^-)M^{+3}(AA^-)_2$ in which:

M is aluminum;

$AA^-$ represents diisopropyl salicylate; and $X^-$ represents the anion of an $\alpha,\beta$-diketone having the formula

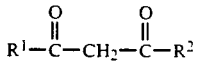

wherein $R^1$ and $R^2$ are lower alkyl.

3. The developer composition of claim 2, wherein the charge director is of the formula $(AcAc^-)Al^{+3}(DIPS^-)_2$ where AcAc represents acetyl acetonate and DIPS represents diisopropyl salicylate.

4. An electrophotographic liquid developer composition comprising, dispersed in an electrically insulating carrier liquid:

(a.) toner comprising particles of a colored resinous phase, additionally containing an incompatible phase;

(b.) an antistain agent selected from the group consisting of: (i) ethoxylated derivatives of fatty acids, alcohols and amides; (ii) alkyl phosphates and phosphonates and metal salts thereof; (iii) homopolymers of ethylene oxide; and (iv) copolymers of ethylene and propylene oxide; and (c.) a charge director comprising a metal salt of the formula $(X^-)_aM^{+n}(AA^-)_b$ in which:

M is a metal atom;

$AA^-$ represents the anion of an ortho-hydroxy aromatic acid;

$X^-$ represents the anion of an $\alpha,\beta$-diketone;

n is 2, 3 or 4; and a and b are integers the sum of which is equal to n, with the proviso that neither a nor b is 0.

5. A process for making an electrophotographic liquid developer composition, which comprises dispersing, in an electrically insulating carrier liquid:

a toner comprised of particles of a colored resinous phase;

an antistain agent; and a charge director comprising a metal salt of the formula $(X^-)_aM^{+n}(AA^-)_b$ in which:

M is a metal atom;

$AA^-$ represents the anion of an ortho-hydroxy aromatic acid;

$X^-$ represents the anion of an $\alpha,\beta$-diketone;

n is 2, 3 or 4; and a and b are integers the sum of which is equal to n, with the proviso that neither a nor b is 0.

6. In a process for developing an electrostatic charge pattern using a consecutive color toning system, the process comprising (a) forming an initial electrostatic charge pattern on a substrate and developing the initial pattern with a first liquid developer composition comprising toner particles of a resinous phase containing a first colorant dispersed in an insulating carrier liquid, then (b) forming a second electrostatic charge pattern on the substrate and developing the second pattern with a second liquid developer composition comprising toner particles of a resinous phase containing a second colorant dispersed in an insulating carrier liquid, the improvement which comprises:

conducting the developing steps in immediate succession without any additional processing steps therebetween; and including in said first and second liquid developer compositions a charge director comprising a metal salt of the formula $(X^-)_aM^{+n}(AA^-)_b$ in which:

M is a metal atom;

$AA^-$ represents the anion of an ortho-hydroxy aromatic acid;

$X^-$ represents the anion of an $\alpha,\beta$-diketone;

n is 2, 3 or 4; and a and b are integers the sum of which is equal to n, with the proviso that neither a nor b is 0.

7. The process of claim 6, further comprising repeating steps (a) and (b) with third and fourth colorants to provide a developed image.

8. The process of claim 7, further including (d) transferring the developed image provided in step (c) to a surface of a selected substrate so as to give rise to an electrophotographic color print thereon.

9. The process of claim 7, wherein the charge director is of the formula $(X^-)M^{+3}(AA^-)_2$ in which:

M is aluminum;

$AA^-$ represents diisopropyl salicylate; and $X^-$ represents the anion of an $\alpha,\beta$-diketone having the formula

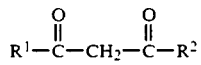

wherein $R^1$ and $R^2$ are lower alkyl.

10. The process of claim 6, wherein the charge director is of the formula $(X^-)M^{+3}(AA^-)_2$ in which:

M is aluminum;

$AA^-$ represents diisopropyl salicylate; and $X^-$ represents the anion of an $\alpha,\beta$-diketone having the formula

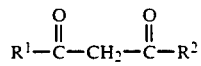

wherein $R^1$ and $R^2$ are lower alkyl.

11. An electrophotographic image constituting a composite color print, comprising, deposited on a substrate in a predetermined pattern:

toner comprised of a colored resinous phase;

an antistain agent; and a charge director comprising a metal salt of the formula $(X^-)_aM^{+n}(AA^-)_b$ in which M is a metal atom, $AA^-$ represents the anion of an ortho-hydroxy aromatic acid, $X^-$ represents the anion of an $\alpha,\beta$-diketone, n is 2, 3 or 4, and a and b are integers the sum of which is equal to n, with the proviso that neither a nor b is 0.

* * * * *